US012618191B2

(12) United States Patent
Jo et al.

(10) Patent No.: US 12,618,191 B2
(45) **Date of Patent: *May 5, 2026**

(54) ADAPTIVE SCENT DISPENSING FOR DRYER APPLIANCE BASED ON INPUT FROM LINKED WASHER APPLIANCE

(71) Applicant: Haier US Appliance Solutions, Inc., Wilmington, DE (US)

(72) Inventors: Jaewon Jo, Seongnam (KR); Seong Hoon Ryu, Suwon (KR); Han Young Kim, Seongnam (KR); Jisoo Kim, Seongnam (KR); Je Kwon Yoon, Hwaseong (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 800 days.

This patent is subject to a terminal disclaimer.

(21) Appl. No.: 17/964,852

(22) Filed: Oct. 12, 2022

(65) Prior Publication Data

US 2024/0125041 A1 Apr. 18, 2024

(51) Int. Cl.
*D06F 58/44* (2020.01)
*D06F 34/04* (2020.01)
(Continued)

(52) U.S. Cl.
CPC ..... *D06F 58/44* (2020.02); *D06F 34/04* (2020.02); *D06F 2103/04* (2020.02); *D06F 2103/60* (2020.02)

(58) Field of Classification Search
CPC ..... D06F 58/44; D06F 34/04; D06F 2103/04; D06F 2103/60
(Continued)

(56) References Cited

U.S. PATENT DOCUMENTS 5,966,831 A * 10/1999 Anderson ..... C11D 17/047 34/60
7,020,986 B1 * 4/2006 Nakai ..... D06F 58/22 68/139
(Continued)

FOREIGN PATENT DOCUMENTS

EP 3705617 A1 * 9/2020 ..... D06F 25/00
KR 20210125122 A * 10/2021 ..... D06F 25/00
(Continued)

OTHER PUBLICATIONS

Wendy Treinen, "GE Appliances Shuts The Door On Odor With Revolutionary New Ultrafresh Front Load Washer", GE Appliances Pressroom, Dec. 3, 2019, Retrieved from Internet: https://pressroom.geappliances.com/news/ge-appliances-shuts-the-door-on-odor-with-revolutionary-new-ultrafresh-front-load-washer.

*Primary Examiner* — Stephen M Gravini
(74) *Attorney, Agent, or Firm* — Dority & Manning, P.A.

(57) ABSTRACT

A dryer appliance and a method of operating a dryer appliance are provided. The dryer includes a drum defining a drying chamber rotatably mounted within a cabinet, an additive dispensing assembly to provide a dryer additive to the drying chamber, and a controller for initiating a drying operation. The controller obtains washer operating parameters from a washing machine, determines a drying operation based on the received parameters, initiates a dry cycle, and directs a dryer additive to be dispensed based on the dryer operating schedule.

18 Claims, 7 Drawing Sheets

(51) Int. Cl.
*D06F 103/04* (2020.01)
*D06F 103/60* (2020.01)

(58) Field of Classification Search
USPC ..... 34/595–610, 380
See application file for complete search history.

(56) References Cited

U.S. PATENT DOCUMENTS 7,059,065 B2 * 6/2006 Gerlach ..... D06F 58/203 34/418
7,353,622 B2 * 4/2008 Bringewatt ..... D06F 37/30 34/312
7,946,054 B2 * 5/2011 Dittmer ..... D06F 58/04 378/173
8,112,904 B2 * 2/2012 Kono ..... D06F 25/00 68/5 R
8,997,375 B2 4/2015 Bae et al.
10,626,544 B2 4/2020 Kim et al.
10,772,477 B2 * 9/2020 Khazaieli ..... D06F 58/203
11,230,803 B2 * 1/2022 Hombroek ..... D06F 35/006
11,230,806 B2 * 1/2022 Welch ..... D06F 25/00
11,242,632 B1 * 2/2022 Zeru ..... D06F 39/12
11,268,233 B2 * 3/2022 Deininger ..... D06F 58/00
11,513,478 B2 * 11/2022 Kim ..... G05B 13/027
11,596,278 B2 * 3/2023 Yoo ..... A47K 10/48
11,891,750 B2 * 2/2024 Rodriguez Munoz ..... D06F 58/203
2020/0002873 A1 1/2020 Chae et al.
2021/0301447 A1 9/2021 Choe et al.
2024/0125041 A1 * 4/2024 Jo ..... D06F 58/44
2024/0279861 A1 * 8/2024 Di Maggio ..... D06F 33/34

FOREIGN PATENT DOCUMENTS

WO WO-2020184735 A1 * 9/2020 ..... D06F 25/00
WO WO2021120955 A1 6/2021

* cited by examiner

ADAPTIVE SCENT DISPENSING FOR DRYER APPLIANCE BASED ON INPUT FROM LINKED WASHER APPLIANCE

FIELD OF THE INVENTION

The present subject matter relates generally to laundry appliances, and more particularly, to dryer appliances and methods of improving dryer operation based on input from a linked washing machine appliance.

BACKGROUND OF THE INVENTION

Laundry appliances, such as washing machine appliances and dryer appliances, are commonly used to wash and dry, respectively, a load of clothes. Specifically, washing machine appliances generally include a wash tub for containing water or wash fluid and a wash basket rotatably mounted within the wash tub for receiving the load of clothes. These washing machines are typically equipped to determine the weight of a load of clothes to operate efficiently in one or more modes or cycles, such as wash, rinse, and spin cycles. After the washing machine processes are complete, the load of clothes is moved over the to the dryer, which includes a cabinet with a drum rotatably mounted therein and a heating assembly that supplies heated air into a chamber of the drum, e.g., through a duct mounted to a back wall of the drum, to facilitate a drying process.

It is sometimes desirable to dispense an additive into the dryer appliance to add a scent to the clothes or modify the characteristics of the fabric. Typically, this is achieved by manually introducing the additive to the dryer appliance at the beginning of the drying cycle. For instance, dryer sheets may be placed within the drum of a dryer appliance to affect the smell or performance (e.g., wrinkle reduction) of the fabrics or clothes being treated (i.e., tumbled or dried) in a specific laundry load. A user must generally remember to supply the additive to each dryer load. Limitations of the manual addition practice can arise during the use of laundry appliances if introduction of the additive is overlooked, made at a less than the ideal time, or at an incorrect dosage. Any of these events may negatively impact the performance of the clothes drying operation.

Accordingly, a dryer appliance capable of delivering one or more additives at the correct time and in the correct dosage to beneficially affect the smell or performance of fabrics would be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance comprising a cabinet and a drum mounted for rotation within the cabinet is provided. The drum defines drying chamber for receipt of clothes for drying. An additive dispensing assembly is positioned within the cabinet and configured to selectively provide a dryer additive to the drying chamber. A controller is in operable communication with the additive dispensing assembly and is configured to initiate a dryer operation. The dryer operation comprises obtaining washer operating parameters from a washing machine appliance; determining a dryer operating schedule based on obtaining the washer operating parameters; initiating a dry cycle for a laundry load; and directing a dispensing action of the dryer additive at the additive dispensing assembly based on the dryer operating schedule.

In another exemplary aspect of the present disclosure, a method of operating a dryer appliance comprising a cabinet, a drum defining a drying chamber, and an additive dispensing assembly is provided. The method comprises obtaining washer operating parameters from a washing machine appliance; determining a dryer operating schedule based on obtaining washer operating parameter; initiating a dry cycle for a laundry load following obtaining the washer operating parameters; and directing a dispensing action of a dryer additive at the additive dispensing assembly based on the dryer operating schedule.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
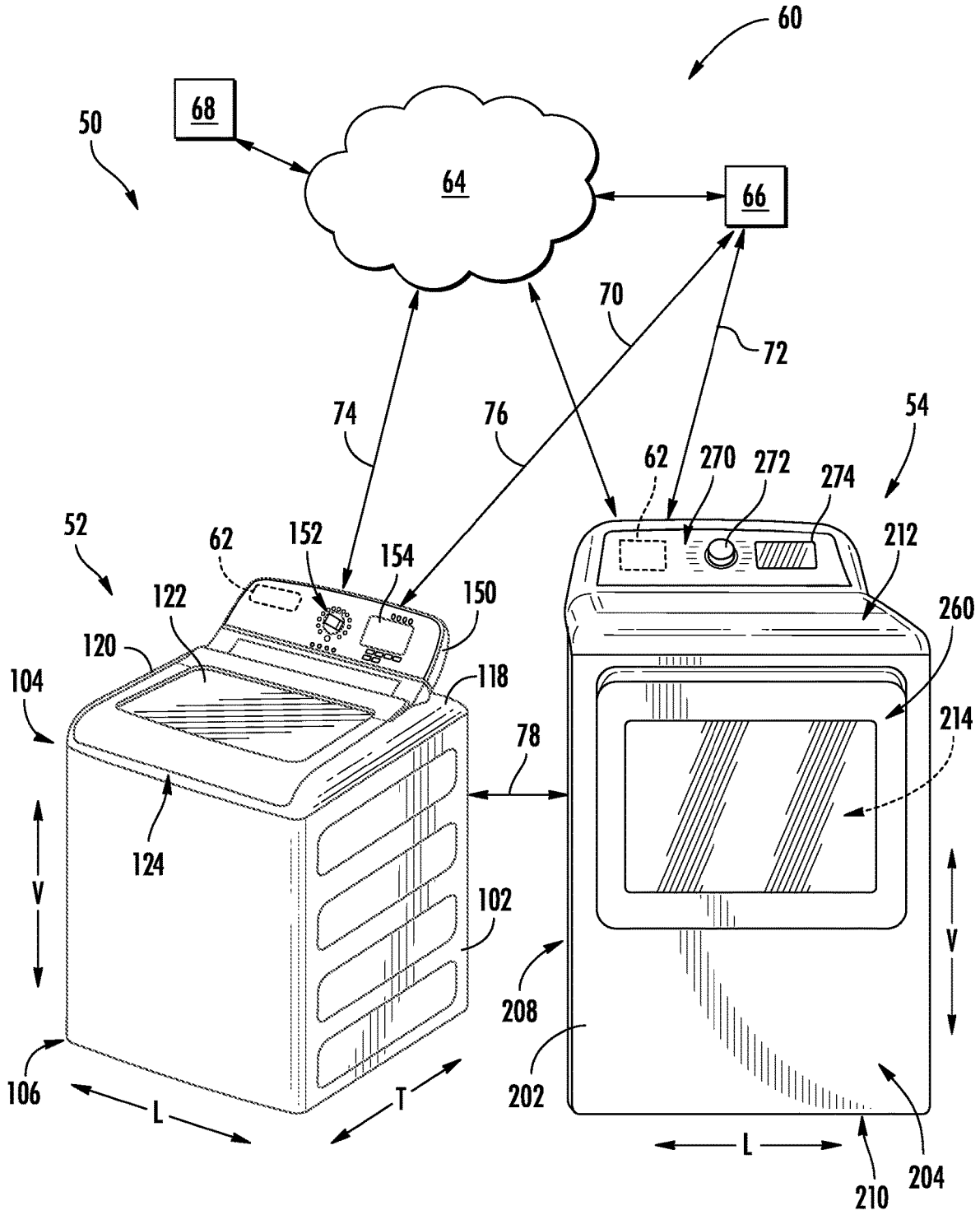
FIG. 1 provides a schematic representation of a laundry appliance system that includes a washing machine appliance, a dryer appliance, and an external communication system according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a laundry appliance system 50 according to exemplary embodiments of the present subject matter. As shown, laundry appliance system 50 generally includes a washing machine appliance 52 and a dryer appliance 54, for washing and drying clothes, respectively. Each of washing machine appliance 52 and dryer appliance 54 will be described below according to exemplary embodiments of the present subject matter. Specifically, these figures illustrate various views of washing machine 52 and dryer appliance 54 in order to facilitate discussion regarding the use and operation of laundry system 50. However, it should be appreciated that the specific appliance configurations illustrated and described are only exemplary, and the scope of the present subject matter is not limited to the configurations set forth herein. Furthermore, it should be appreciated that like reference numerals may be used to refer to the same or similar features between washing machine appliance 52 and dryer appliance 54.

Referring still to FIG. 1, a schematic diagram of an external communication system 60 will be described according to an exemplary embodiment of the present subject matter. In general, external communication system 60 is configured for permitting interaction, data transfer, and other communications between and among washing machine 52, dryer appliance 54, or a user of such appliances. For example, this communication may be used to provide and receive operating parameters, cycle settings, performance characteristics, user preferences, or any other suitable information for improved performance of laundry system 50. For example, operating parameters or load characteristics at the washing machine appliance 52 may be communicated to the dryer appliance 54.

As illustrated, each of washing machine appliance 52 and dryer appliance 54 may include a controller 62 (described in more detail below). External communication system 60 permits controllers 62 of washer appliance 52 and dryer appliance 54 to be communicatively linked to support communication with each other and with external devices either directly or through a network 64. For example, a consumer may use a consumer device 66 linked to at least one of the washing machine 52 or dryer appliance 54 to communicate directly with washing machine 52 via direct link 70 or dryer appliance 54 via direct link 72. Alternatively, these appliances may include user interfaces for receiving such input (described below). For example, consumer devices 66 may be linked in direct or indirect communication with washing machine 52 and dryer appliance 54, e.g., directly through a local area network (LAN), Wi-Fi®, Bluetooth®, etc. (via 70, 72 respectively) or indirectly through network 64 via indirect links 74 with the washing machine appliance and 76 with the dryer appliance. In general, consumer device 66 may be any suitable device for providing or receiving communications or commands from a user. In this regard, consumer device 66 may include, for example, a personal phone, a tablet, a laptop computer, or another mobile device.

In addition, a remote server 68 may be in communication with washing machine appliance 52, dryer appliance 54, or consumer device 66 through network 64 and indirect links 74, 76, respectively. In this regard, for example, remote server 68 may be a cloud-based server 68, and is thus located at a distant location, such as in a separate state, country, etc. In general, communication between the remote server 68 and the client devices may be carried via a network interface using any type of wireless connection, using a variety of communication protocols (e.g., TCP/IP, HTTP, SMTP, FTP), encodings or formats (e.g., HTML, XML), or protection schemes (e.g., VPN, secure HTTP, SSL).

In general, network 64 can be any type of communication network. For example, network 64 can include one or more of a wireless network, a wired network, a personal area network, a local area network, a wide area network, the internet, a cellular network, etc. According to an exemplary embodiment, consumer device 66 may communicate with a remote server 68 over network 64, such as the internet, to provide user inputs, transfer operating parameters or performance characteristics, etc. In addition, consumer device 66 and remote server 68 may communicate with washing machine 52 and dryer appliance 54 to communicate similar information.

External communication system 60 is described herein according to an exemplary embodiment of the present subject matter. However, it should be appreciated that the exemplary functions and configurations of external communication system 60 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 2:
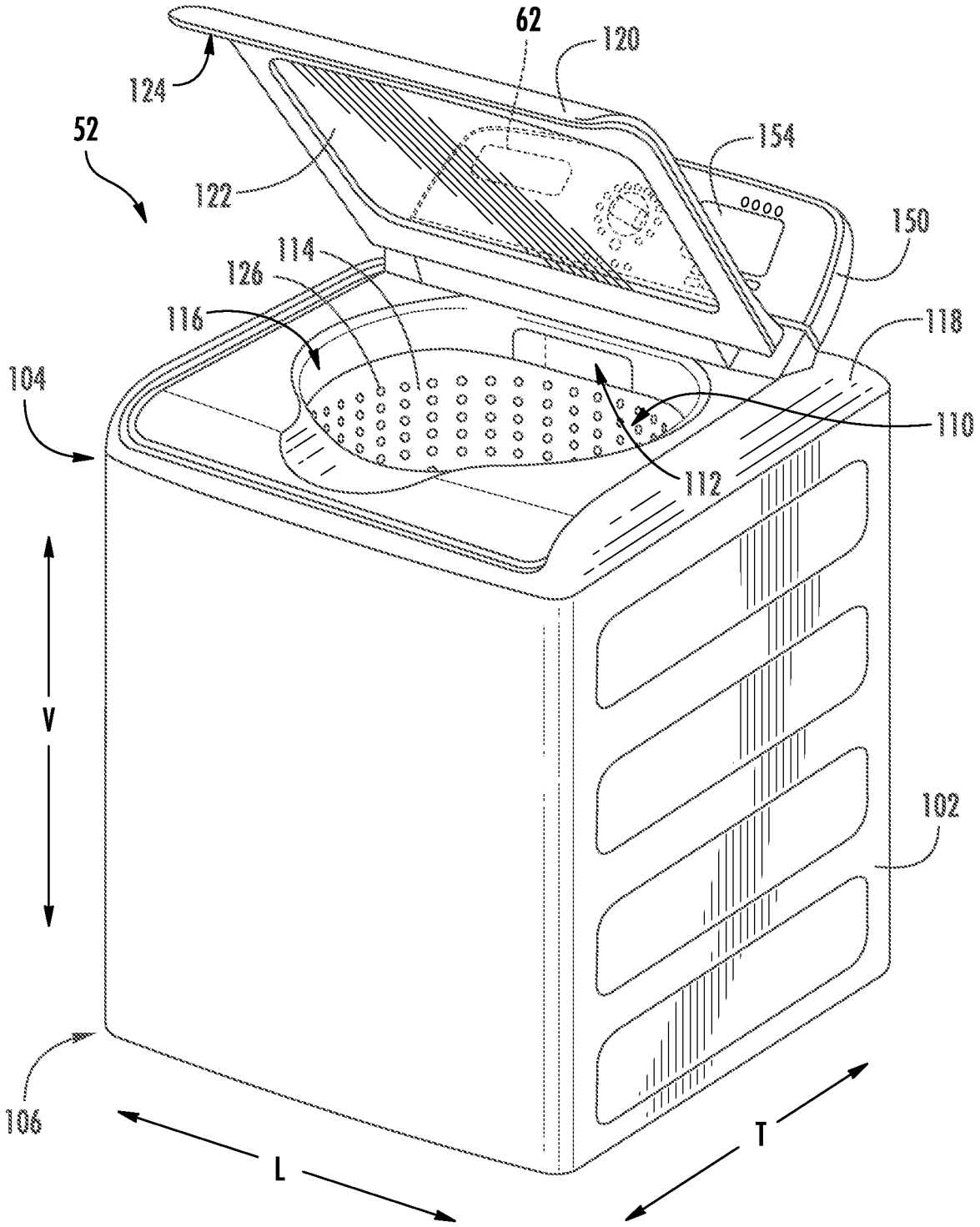
FIG. 2 provides a perspective view of the exemplary washing machine appliance of FIG. 1 with the door of the exemplary washing machine appliance shown in an open position.
Figure 3:
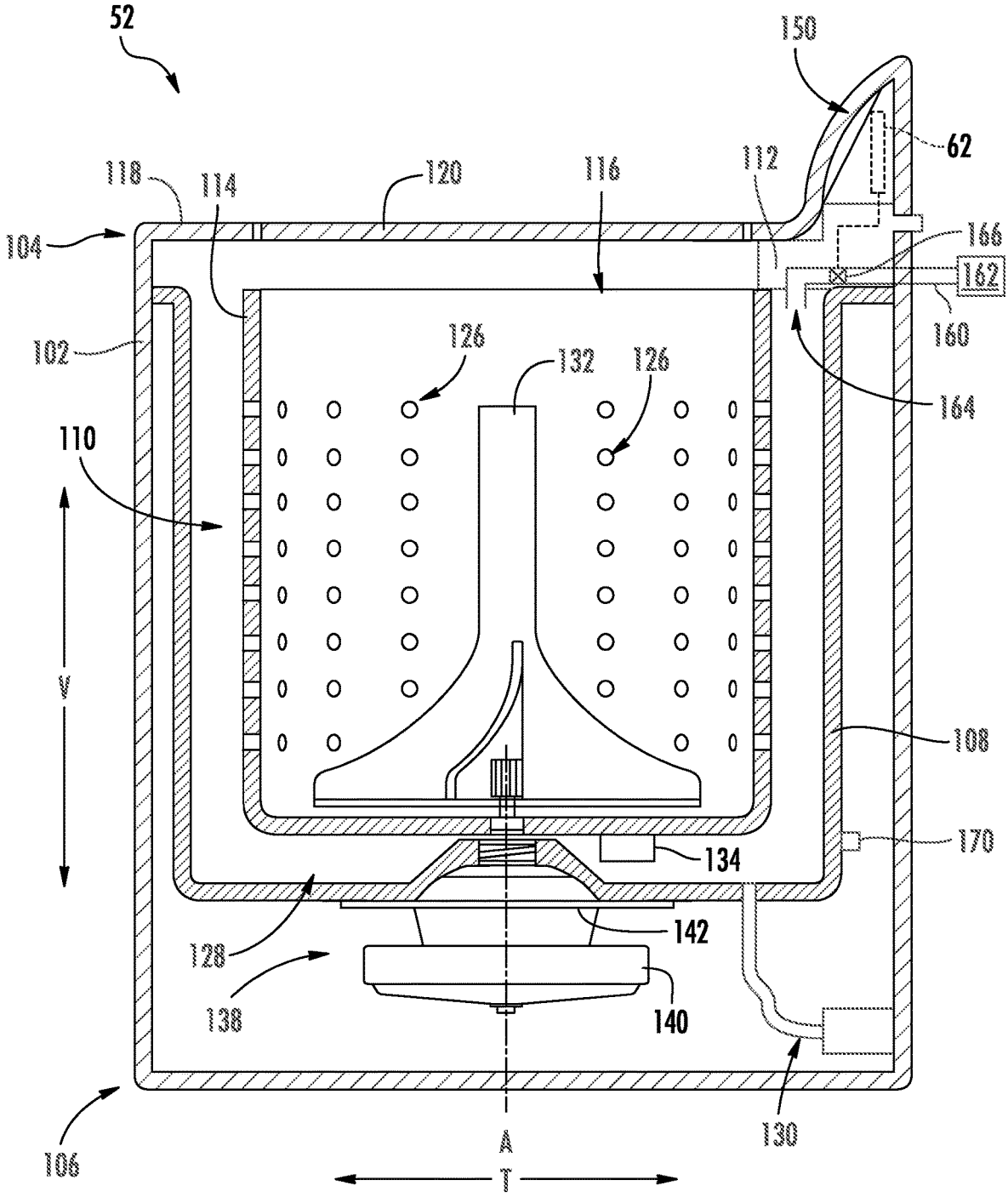
FIG. 3 provides a side cross-sectional view of the exemplary washing machine appliance of FIG. 1.

Referring now also to FIGS. 2 and 3, washing machine appliance 52 will be described according to an exemplary embodiment of the present subject matter. Specifically, these figures illustrate an exemplary embodiment of a vertical axis washing machine appliance 52. Specifically, FIGS. 1 and 2 illustrate perspective views of washing machine appliance 52 in a closed and an open position, respectively. FIG. 3 provides a side cross-sectional view of washing machine appliance 52. Washing machine appliance 52 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 52, it should be appreciated that vertical axis washing machine appliance 52 is provided by way of example only. It will be understood that aspects of the present subject matter may be used in any other suitable washing machine appliance, such as a horizontal axis washing machine appliance. Indeed, modifications and variations may be made to washing machine appliance 52, including different configurations, different appearances, or different features while remaining within the scope of the present subject matter.

Washing machine appliance 52 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 52 further includes a primary dispenser 112 for dispensing wash fluid into wash tub 108. The term "wash fluid" refers to a liquid used for washing or rinsing articles during an operating cycle and may include any combination of water, detergent, fabric softener, bleach, and other wash additives or treatments.

In addition, washing machine appliance 52 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 52 is generally referred to as a "vertical axis" or "top load" washing machine appliance 52. However, it should be appreciated that aspects of the present subject matter may be used within the context of a horizontal axis, or front load, washing machine appliance as well.

As illustrated, cabinet 102 of washing machine appliance 52 has a top panel 118. Top panel 118 defines an opening (FIG. 2) that coincides with opening 116 of wash basket 114 to permit a user access to wash basket 114. Washing machine appliance 52 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 52. Door 120 also includes a handle 124 that, e.g., a user may pull or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 52 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 52, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 52 includes a drive assembly 138 in mechanical communication with wash basket 114 to selectively rotate wash basket 114 (e.g., during an agitation or a rinse cycle of washing machine appliance 52). In addition, drive assembly 138 may also be in mechanical communication with agitation element 132. In this manner, drive assembly 138 may be configured for selectively rotating or oscillating wash basket 114 or agitation element 132 during various operating cycles of washing machine appliance 52.

More specifically, drive assembly 138 may generally include one or more of a drive motor 140 and a transmission assembly 142, e.g., such as a clutch assembly, for engaging and disengaging wash basket 114 or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, or other items of interest to appliance users regarding operation.

Operation of washing machine appliance 52 is controlled by a controller or processing device 62 that is operatively coupled to control panel 150 for user manipulation to select washing machine cycles and features. In response to user manipulation of control panel 150, controller 62 operates the various components of washing machine appliance 52 to execute selected machine cycles and features. According to an exemplary embodiment, controller 62 may include a memory and microprocessor, such as a general or special purpose microprocessor operable to execute programming instructions or micro-control code associated with methods described herein. Alternatively, controller 62 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 150 and other components of washing machine appliance 52 may be in communication with controller 62 via one or more signal lines or shared communication busses.

During operation of washing machine appliance 52, laundry items are loaded into wash basket 114 through opening 116, and washing operation is initiated through operator manipulation of input selectors 152. Prior to any addition of wash fluid, washing machine appliance 52 may determine the weight of the dry clothes in the wash basket 114, for example using a weight sensor 134 affixed to the wash basket 114. The weight of the dry clothes is a load characteristic specific to each individual wash load and may be communicated to the dryer appliance 54 and stored in a memory location of dryer controller 62 for processing. Alternately or additionally, the weight of the dry clothes may be a load characteristic saved in a memory location of controller 62 in the washing machine appliance 52 for processing.

Wash basket 114 is filled with water and detergent or other fluid additives via primary dispenser 112. One or more valves can be controlled by washing machine appliance 52 to provide for filling wash tub 108 and wash basket 114 to the appropriate level for the volume and weight of articles being washed or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 52 includes a water supply conduit 160 that provides fluid communication between a water supply source 162 (such as a municipal water supply) and a discharge nozzle 164 for directing a flow of water into wash chamber 110. In addition, washing machine appliance 52 includes a water fill valve or water control valve 166 which is operably coupled to water supply conduit 160 and communicatively coupled to controller 62. In this manner, controller 62 may regulate the operation of water control valve 166 to regulate the amount of water within wash tub 108. In addition, washing machine appliance 52 may include one or more pressure sensors 170 for detecting the amount of water and/or clothes within wash tub 108. For example, pressure sensor 170 may be operably coupled to a side of tub 108 for detecting the weight of wash tub 108, which controller 62 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle or after the rinse cycle in order to wring wash fluid from the articles being washed. During a spin cycle, wash basket 114 is rotated at relatively high speeds to help wring fluid from the laundry articles through perforations 126.

After the spin cycle, the weight of the clothes with residual water may be determined, for example by weight sensor 134 or pressure sensor 170, alone or in combination. The weight of the clothes with residual water may be a load characteristic and may be communicated to the dryer appliance 54. Alternately or additionally, the weight of the clothes and residual water may be a load characteristic saved in a memory location of controller 62 of the washing machine appliance 52 for processing. From this load characteristic and the weight of the dry clothes prior to initiation of the wash cycle, the weight of water remaining in the clothes after completion of the spin cycle (i.e., at the end of the wash cycle) can be determined. The weight of the residual water is a load characteristic and may be communicated to the dryer appliance 54 or stored in a memory location of controller 62 of the washing machine appliance 52 for processing.

After articles disposed in wash basket 114 are cleaned or washed, the user can remove the articles from wash basket 114, e.g., by reaching into wash basket 114 through opening 116.

Figure 4:
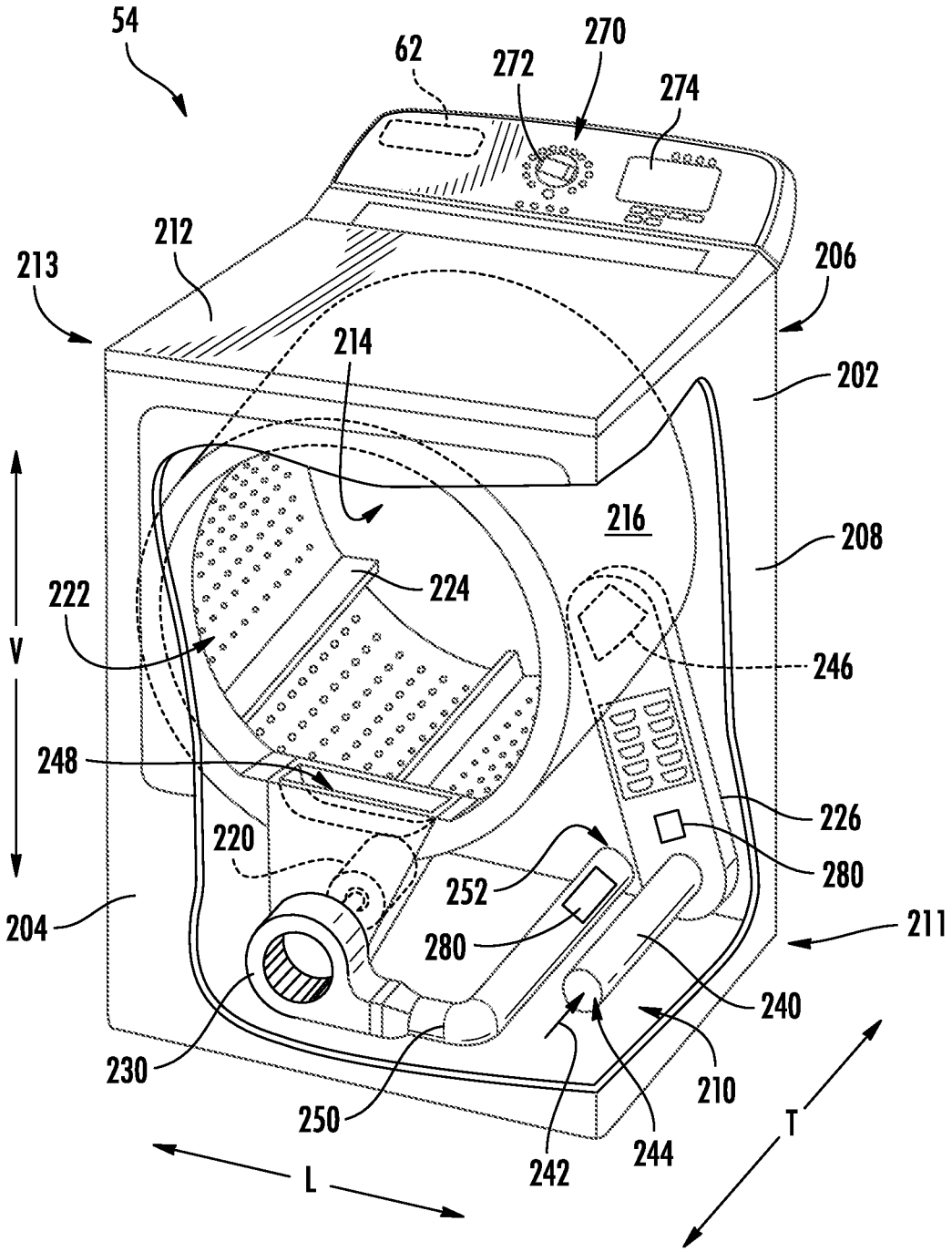
FIG. 4 provides a perspective view of the exemplary dryer appliance of FIG. 1, with portions of a cabinet of the dryer appliance removed to reveal certain components of the dryer appliance.
Figure 5:
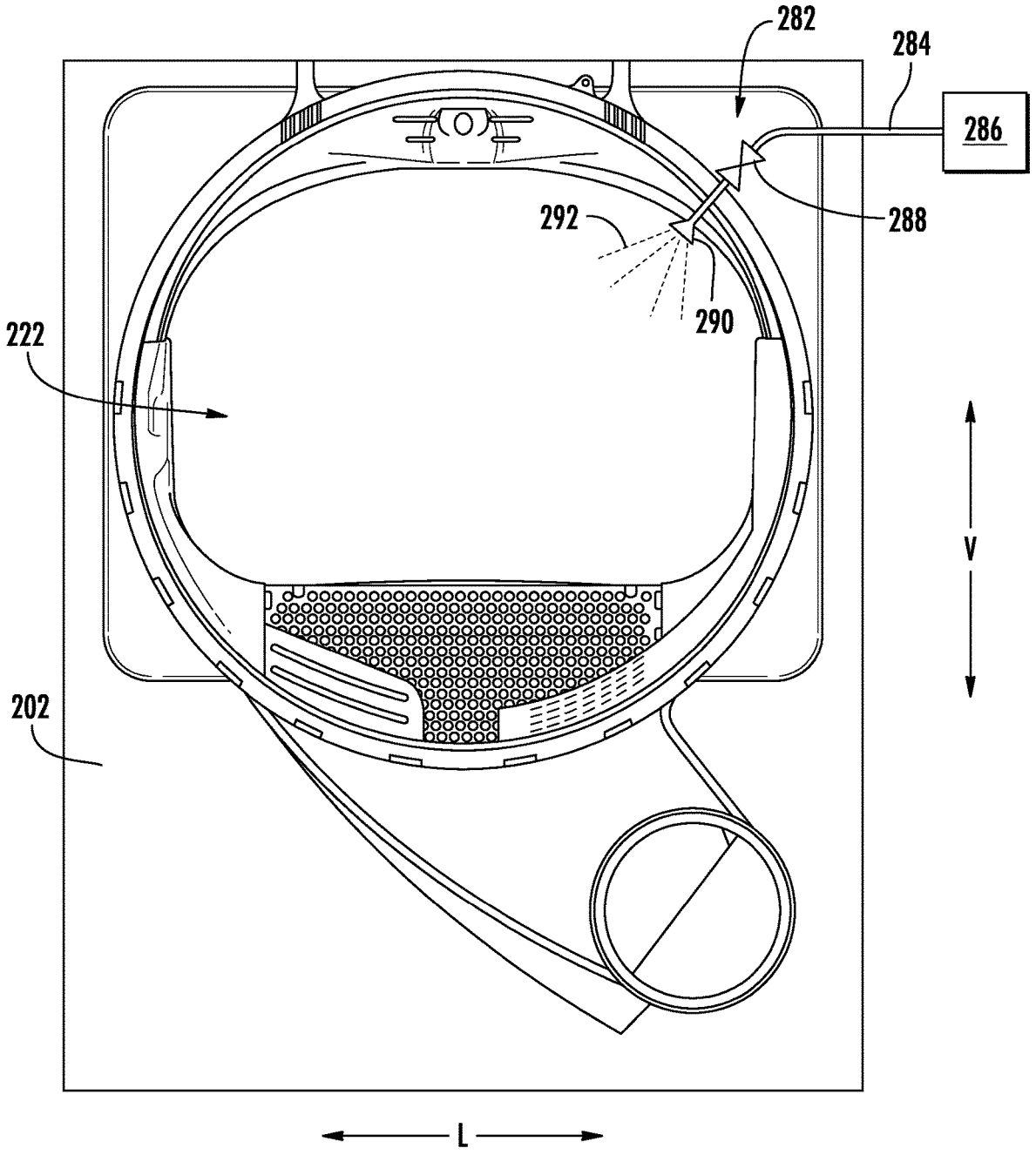
FIG. 5 provides a partial, perspective view of a drying chamber of the exemplary dryer appliance of FIG. 1.

Referring now to FIGS. 4 and 5, FIG. 4 provides a perspective view of exemplary dryer appliance 54 with a portion of a cabinet 202 of dryer appliance 54 removed in order to show certain components of dryer appliance 54. FIG. 5 provides a partial, perspective view of a drying chamber 214 of dryer appliance 54. While described in the context of a specific embodiment of dryer appliance 54, using the teachings disclosed herein it will be understood that dryer appliance 54 is provided by way of example only. Other dryer appliances having different appearances and different features may also be utilized with the present subject matter as well, such as a vertical axis dryer appliance. Indeed, modifications and variations may be made to dryer appliance 54, including different configurations, different appearances, or different features while remaining within the scope of the present subject matter.

Dryer appliance 54 generally defines a vertical direction V, a lateral direction L, and a transverse direction T, each of which is mutually perpendicular, such that an orthogonal coordinate system is generally defined. The V, L, and T directions may use the same reference frame as those used in describing washing machine appliance 52. Cabinet 202 includes a front panel 204, a rear panel 206, a pair of side panels 208 spaced apart from each other by front and rear panels 204 and 206 spaced apart in the T direction, a bottom panel 210 at a lower portion 211, and a top cover 212 at an upper portion 213, spaced apart in the V direction. Within cabinet 202 is a drum or container 216 mounted for rotation about a substantially horizontal axis, e.g., that is parallel or substantially parallel to the transverse direction T. Drum 216 defines a chamber 214 for receipt of articles, e.g., clothing, linen, etc., for drying. Drum 216 extends between a front portion and a back portion, e.g., along the transverse direction T. In this configuration, dryer appliance 54 is sometimes referred to as a "front load" dryer appliance. In other embodiments of this disclosure, the drum 216 may extend between the upper portion 213 and lower portion 211 with access to chamber 214 provided through top cover 212. In this configuration, the dryer appliance 54 may be referred to as a "top loading" dryer appliance. Operating principles of "front loading" and "top loading" dryer appliances are substantially similar.

A motor 220 is configured for rotating drum 216 about the horizontal axis, e.g., via a pulley and a belt (not shown). Drum 216 is generally cylindrical in shape, having an outer cylindrical wall or cylinder and a front flange or wall that defines an entry 222 of drum 216, e.g., at the front portion of drum 216, for loading and unloading of articles into and out of chamber 214 of drum 216. A plurality of tumbling ribs 224 are provided within chamber 214 of drum 216 to lift articles therein and then allow such articles to tumble back to a bottom of drum 216 as drum 216 rotates. Drum 216 also includes a back or rear wall, e.g., such that drum 216 is rotatable on its rear wall as will be understood by those skilled in the art. A duct 226 is mounted to the rear wall of drum 216 and receives heated air that has been heated by a heating assembly or system 240.

Motor 220 is also in mechanical communication with an air handler 230 such that motor 220 rotates air handler 230, e.g., a centrifugal fan. Air handler 230 is configured for drawing air through chamber 214 of drum 216, e.g., in order to dry articles located therein as discussed in greater detail below. In alternative exemplary embodiments, dryer appliance 54 may include an additional motor (not shown) for rotating air handler 230 independently of drum 216.

Drum 216 is configured to receive heated air that has been heated by a heating assembly 240, e.g., in order to dry damp articles disposed within chamber 214 of drum 216. Heating assembly 240 includes a heating element (not shown), such as a gas burner or an electrical resistance heating element, for heating air. As discussed above, during operation of dryer appliance 54, motor 220 rotates drum 216 and air handler 230 such that air handler 230 draws air through chamber 214 of drum 216 when motor 220 rotates. In particular, ambient air (identified herein generally by reference numeral 242) enters heating assembly 240 via an entrance 244 due to air handler 230 urging such ambient air into entrance 244. Such ambient air is heated within heating assembly 240 and exits heating assembly 240 as heated air. Air handler 230 draws such heated air through duct 226 to drum 216. The heated air enters drum 216 through an outlet 246 of duct 226 positioned at the rear wall of drum 216.

Within chamber 214, the heated air can accumulate moisture, e.g., from damp articles disposed within chamber 214. In turn, air handler 230 draws humid air through a trap duct 248 which contains a screen filter (not shown) which traps lint particles. Such humid air then passes through trap duct 248 and air handler 230 before entering an exhaust conduit 250. From exhaust conduit 250, such humid air passes out of dryer appliance 54 through a vent 252 defined by cabinet 202. After the clothing articles have been dried, they are removed from the drum 216 via entry 222. A door 260 (FIG. 1) provides for closing or accessing drum 216 through entry 222.

A user interface panel 270 is positioned on a cabinet backsplash and includes a cycle selector knob 272 that is in communication with a processing device or controller (such as a controller 62). Signals generated in controller 62 operate motor 220, air hander, 230, and heating assembly 240 in response to the position of selector knobs 272. User interface panel 270 may further include additional indicators, a display screen, a touch screen interface 174, etc. for providing information to a user of the dryer appliance 54 and receiving suitable operational feedback. Alternatively, a touch screen type interface, knobs, sliders, buttons, speech recognition, etc., mounted to cabinet backsplash or at any other suitable location to permit a user to input control commands for dryer appliance 54 or controller 62.

Controller 62 may include memory and one or more processing devices such as microprocessors, CPUs or the like, such as general or special purpose microprocessors operable to execute programming instructions or micro-control code associated with operation of dryer appliance 54. The memory can represent random access memory such as DRAM or read only memory such as ROM or FLASH. The processor executes programming instructions stored in the memory. The memory may be a separate component from the processor or may be included onboard within the processor. Alternatively, controller 62 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

In general, controller 62 is in operative communication with various components of dryer appliance 54. In particular, controller 62 is in operative communication with motor 220 and heating assembly 240. Thus, upon receiving an activation signal from cycle selector knob 272, controller 62 can activate motor 220 to rotate drum 216 and air handler 230. Controller 62 can also activate heating assembly 240 in order to generate heated air for drum 216, e.g., in the manner described above.

Dryer appliance controller 62 is also in communication with a thermal or temperature sensor 280, e.g., a thermocouple or thermistor. Temperature sensor 280 is configured for measuring a temperature of heated air within duct 226. Temperature sensor 280 can be positioned at any suitable location within dryer appliance 54. For example, temperature sensor 280 may be positioned within or on duct 226. Additionally or alternatively temperature sensor 280 may be positioned on exhaust conduit 250. Controller 62 can receive a signal from temperature sensor 280 that corresponds to a temperature measurement of heated air within duct 226 or exhaust conduit 250, e.g., a temperature measurement of heated air exiting duct 226 at outlet 246 or humid air exiting the drum 216 at vent 252.

Referring to FIG. 5, dryer appliance 54 may further include an additive dispensing assembly 282 for selectively providing a dryer additive into chamber 214 (e.g., to treat articles within drum 216). Such dryer additives may include an odor neutralizer (e.g., fluid configured to bind to odor molecules, such as an acidic liquid, antibacterial, or liquid containing protease or amylase enzymes) or a perfume material or liquid to provide a desirable smell or scent to a load. Moreover, it is noted that any other suitable laundry or fabric additive may be included.

In some embodiments, as illustrated, dispensing assembly 282 includes a supply conduit 284 fluidly coupled to an additive reservoir or source 286 (e.g., within cabinet 202 or outside thereof). A supply valve 288 may be operably coupled to supply conduit 284 for regulating the flow or movement of additive therethrough. In optional embodiments, dispensing assembly 282 includes a nozzle 290, such as a misting nozzle, that is fluidly coupled to the supply conduit 284 and is positioned for discharging the flow of additive into chamber 214. Specifically, according to an exemplary embodiment, nozzle 290 is configured for receiving the flow of a liquid additive and generating a fine mist (indicated by reference numeral 292 in FIG. 5) that is dispersed throughout chamber 214. It should be appreciated that according to alternative embodiments, dryer appliance 54 may include any other suitable number, type, position, and configuration of liquid supply nozzles, conduits, motors, paddles, dispensers, or subsystems.

In embodiments, at least supply valve 288 is communicatively coupled to controller 62 of dryer appliance 54 for selective operation of supply valve 288. In particular, controller 62 selectively controls valve 288 for operational frequency and duration, controlling the timing and amount of additive 292 entering the chamber 214.

Additive dispensing assembly 282 may be located within the cabinet 202 with nozzle 290 disposed within drying chamber 214 as depicted in the exemplary embodiment of FIG. 5. It should be noted that the additive dispensing assembly 282 may be place in other locations within and outside of the cabinet 202. In some embodiments, the additive dispensing assembly 282 may be located on or in door 260 of dryer appliance 54. Door 260 may include a cavity suitable to contain the additive dispensing assembly 282 and source 286 and provide nozzle 290 with access to the interior of drying chamber 214.

Now that the construction of system 50, washing machine 52, dryer appliance 54, and external communication system 60 have been presented according to exemplary embodiments, an exemplary method 600 of operating a system of laundry appliances will be described. Although the discussion below refers to the exemplary method 600 of operating system 50 to improve the operation of dryer appliance 54, one skilled in the art will appreciate that the exemplary method 600 is applicable to the monitoring and control of any suitable system of laundry appliances. In exemplary embodiments, the various method steps as disclosed herein may be performed by controllers 62, remote server 68, or a separate, dedicated controller.

Figure 6:
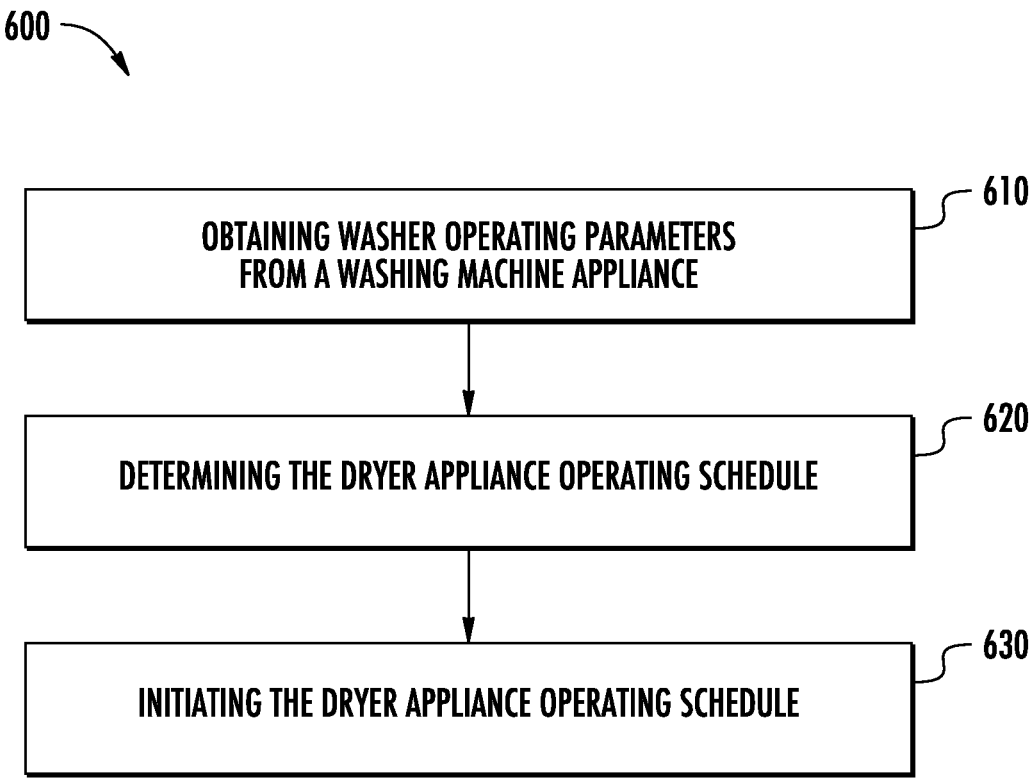
FIG. 6 provides a flow chart illustrating a method of operating a dryer appliance according to exemplary embodiments of the present disclosure.

Referring generally to FIG. 6, a method of operating a dryer appliance in a laundry system is provided. FIG. 6 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure.

Advantageously, methods in accordance with the present disclosure may automatically (e.g., without direct user instruction or intervention) dispense one or more additives affecting the smell or performance of fabrics. Additionally or alternatively, methods in accordance with the present disclosure may facilitate dispensing one or more additives at a variable amount, at variable time(s), and at a variable frequency, or at any combination of amount, time, and frequency, thereby improving dryer performance or customer satisfaction.

At 610, the method 600 includes obtaining washer operating parameters from a washing machine appliance. As used herein, the term "washer operating parameters" and the like is generally intended to refer to any cycle selection, operating parameter, cycle end time, load characteristic, performance characteristic, or other qualitative or quantitative measure or data related to the operation of washing machine appliance or the clothes washed therein (e.g., the laundry load).

For example, according to an exemplary embodiment, the washer operating parameters that are obtained from washing machine appliance 52 may include at least one of a load type, a dry load weight, a dry load weight plus a residual water weight at end of a wash cycle (i.e., weight of clothing load at end of wash cycle, or wet load weight), a remaining moisture content (RMC), or any other operating parameter or characteristic that is implemented or monitored by washing machine appliance 52. In some embodiments, washer operation parameters may include any load characteristics that can be used to determine the length of a drying cycle. In particular, this may include the wet load weight, dry load weight, or the amount of wash fluid or water remaining in the wet clothes, e.g., the calculation of wet load weight minus dry load weight. According to still other exemplary embodiments, the washer operating parameters comprise a washer cycle type or any other suitable input that may be selected by the user of the appliance or determined by controller 62 based on load sensing processes.

It should be appreciated that the washer operating parameters that are received from washing machine appliance 52 may be provided to dryer appliance 54 in any suitable manner. In some embodiments, the washing machine appliance 52 is linked (i.e., communicatively coupled) to the dryer appliance 54. In turn, the washer operating parameters may be obtained from the washing machine appliance 52. Optionally, the parameters may be received from (or through) a remote server or over network 64. In this regard, washing machine appliance 52 may transmit these washer operating parameters to the network 64 or remote server when measured or selected, and dryer appliance 54 may periodically pull or download these parameters from the network 64. In additional or alternative embodiments, dryer appliance 54 may be in direct wireless communication with washing machine appliance, e.g., via direct washing machine appliance-dryer appliance link 78, which may be a Wi-Fi or Bluetooth connection. According to such an embodiment, the washer operating parameters are received directly from washing machine appliance 52. According to still other embodiments, washer operating parameters may be transferred in any other suitable manner, e.g., via user input, a wired connection, etc.

In the event that washer operating parameters are not available, for example, when external communication between and among washing machine appliance 52, dryer appliance 54, or a user of such appliances has been disrupted or is not available, method 600 ceases. A message may be displayed on display 154 or transmitted to consumer device 66 indicating that the washing machine appliance 52 and the dryer appliance 54 are not in communication with each other and user input for dryer appliance instructions is required.

At 620, the method 600 includes determining the dryer appliance operating schedule based on washer operating parameters and predetermined schedule features. In embodiments, the washer operating parameters may include data points such as the dry weight of the washer load (i.e., dry load weight) and the dry load weight plus a residual water weight (i.e., wet load weight), e.g., the load weight at the end of the washing cycle. Data from the washer operating parameters, for example dry load weight or wet load weight, may be stored in a memory location of controller 62 and retrieved for processing. According to exemplary embodiments, the load size may be characterized as an extra-large load, a large load, a medium load, a small load, or any other suitable size therebetween. It should be appreciated that the weight (e.g., in pounds) of the load may be used to characterize the size of the load in some embodiments. In other embodiments, other suitable methods of determining load size may be used, such as a determination based on airflow velocity through the appliance, temperature changes across the appliance, user input, etc.

The data points of dry load weight and wet load weight may be processed by controller 62 to determine the amount of water to be removed in the dryer appliance. The amount of water to be removed may influence the drying operating schedule, for example the cycle duration. Other washer operating parameters, such as load type (e.g., gentle, heavy duty, etc.) or fabric type may also influence the dryer operating schedule.

In embodiments, the dryer operating schedule includes an additive schedule for providing one or more dryer additives (e.g., such as additive mist 292) into the drying chamber. Dryer additives may include a scent (e.g., a perfume) or a fabric performance modifier (e.g., fabric softener, anti-static substance, or wrinkle release agent). The additive schedule may be specific for a particular additive as some dryer additives may have preferred introduction times for optimal effect. For example, some additives may perform optimally if introduced in the drying chamber at the beginning of the dryer cycle, or at the end of the dryer cycle. Other additives may be better introduced to the drying chamber at a fixed time after the cycle starts or a specific amount of time before the cycle ends. Still other additives may be beneficially introduced at more than one point in time during the dryer cycle.

In addition to timing the introduction of dryer additives, the dryer operating schedule may also include the amount or dose of one or more additives to be introduced in total for the dryer load or with each dosing. The amount of additive may be determined by the controller 62 in response to input of washer operating parameters and a predetermined dosing schedule based, for example, on the wet weight or the dry weight of the clothes in the drying chamber as received from the washer appliance or calculated from data received from the washer appliance. In embodiments, controller 62 may execute the additive schedule by selectively operating the supply valve 288 one or more times during the dryer cycle to introduce the calculated, or otherwise determined, optimal amount of additive. Controller 62 may also selectively operate supply valve 288 at the introduction times determined from the data received from the washer appliance or calculated form data received from the washer appliance in executing the additive schedule.

At 630, the method 600 includes initiating a dryer appliance operating schedule for a laundry load following obtaining the washer appliance 52 operating parameters. Generally, such dryer appliance operating schedules include activating the air handler 230 to urge an airflow through the drying chamber 214. For instance, 630 may include activating the blower or air handler 230. In turn, the air handler 230 may urge air through a heating assembly 240, including an inlet conduit defining an air entrance 244, and into the drying chamber 214 defined by an appliance drum 216. From the drying chamber 214, air handler 230 may further urge air through an exhaust conduit 250 defining an air exhaust passage to vent 252. Simultaneous to or separate from the motivated airflow, the heating assembly 240 may be activated to heat the airflow or drying chamber, generally (e.g., as would be understood).

At the initiation of a dry cycle, 630 may include the controller 62 selectively operating the supply valve 288 to provide a predetermined initial dosing of additive based on the obtained washer operating parameters. The initial dose of additive may occur prior to activating the heating assembly 240 or within a set initial time period of the dry cycle. Controller 62 may be in communication, directly or indirectly, with the additive dispensing assembly 282 to control the amount, timing and frequency of additive introduction to the drying chamber during the dryer cycle.

The amount or volume of additive introduced at 630 may be variable. In some embodiments, based on the dry load weight or wet load weight of the clothes, a volume of the dryer additive may be determined. For instance, a formula, model, or lookup table may be provided to correlate a specific dry load weight, or wet load weight, or range of such weights, to a corresponding additive volume. In certain embodiments, determining the additive volume includes selecting the additive volume from a plurality of predetermined volumes. For instance, each predetermined volume of the plurality of predetermined volumes may correspond to a unique wet or dry load weight (or range of wet or dry load weight).

Figure 7:
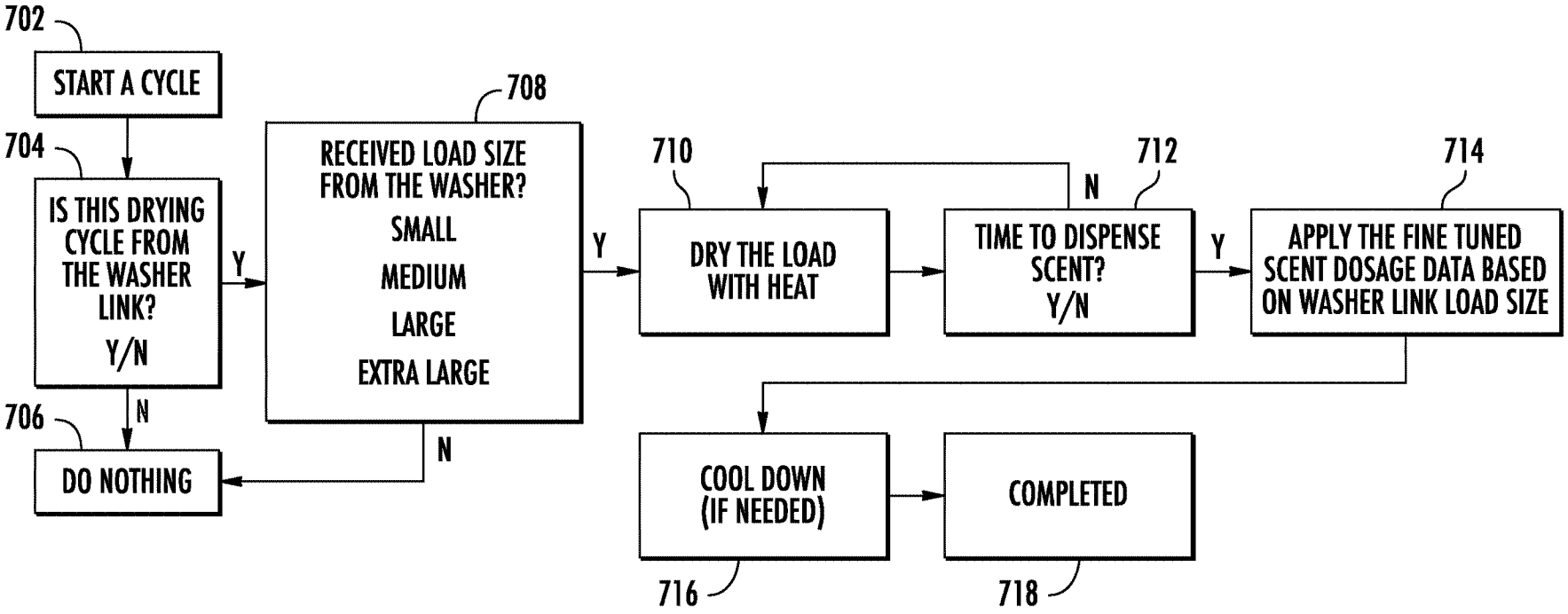
FIG. 7 provides a flow diagram illustrating an exemplary process for adaptive scent dispensing in a dryer appliance based on input from a linked washer appliance.

Referring briefly to FIG. 7, a flow diagram illustrating an exemplary process for an automatic adaptive scent dispensing schedule in a dryer appliance based on input from a linked washer appliance is provided. More specifically, process 700 may be implemented by dryer appliance 54 in laundry appliance system 50. According to exemplary embodiments, method 700 may be similar to, or interchangeable with, method 600 and may be implemented by controller 62 of dryer appliance 54.

As shown, at step 702, dryer cycle, method 700 starts with input from a user indicating a desire to start a dryer cycle to dry a load of wet clothes from a washing machine apparatus. The default logic expects that the dryer appliance 54 will be processing (e.g., drying) clothes recently processed in the linked washing machine appliance 52. However, the load of wet clothes may or may not have come from a linked washing machine 52 or the communication anticipated from a linked washing machine apparatus 52 was interrupted, incomplete, or otherwise unusable.

Accordingly, at 704, method 700 queries the dryer appliance controller 62 for washer operating parameters pertaining to the current load of wet clothes. If the washer operating parameters have not been successfully communicated from the washing machine appliance 52 to the dryer appliance 54, the automatic adaptive scent dispensing method stops at 706. The dryer may indicate, via, for example, an audible or graphic signal on the display 274 or consumer device 66, that the washer operating parameters for the current load of wet clothes have not been received and user intervention is required. User intervention could include re-establishing communication with a linked washing machine appliance or manually entering sufficient operating parameters through the user interface 270 or wirelessly through consumer device 66 to allow the automatic adaptive scent dispensing schedule to begin.

If the dryer appliance 54 is successfully linked to the washing machine appliance 52, the dryer appliance 54 queries the successful receipt of the washer operation parameters. At 708, the dryer appliance confirms receipt of a necessary washer operation parameter, for example the load size. The load size may be qualitative (e.g., small, medium, large, etc.) or qualitative in sensed or calculated weight (e.g., pounds).

From the washer operation parameters, e.g., load size, the dryer operation schedule can be determined. For example, the duration of the dryer operation can be determined form historical data, a look-up table, or a mathematical formula represented by programming steps and executed in the controller. Included in the determined duration of the drying operation and the size of the load, the timing, frequency, and amount of additive can also be determined.

At 710, the load of clothes is subject to heat for drying during the dryer operation. The operation schedule enters a loop with 710 and 712, with 712 querying a run timer to determine if a time to dispense the additive, e.g., scent, has been reached. If a time has not been reached, the drying operation continues. When a time has been reached as determined at 712, the methos proceeds to 714 and the additive is applied in the amount determined by the load size per the communicated washer operation parameters.

After application of the additive, the method proceeds to a cool down period, if needed, at 716. At the completion of the cool down, the method 700 reaches the end and stops.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a drying chamber for receipt of clothes for drying;

an additive dispensing assembly positioned within the cabinet and configured to selectively provide a dryer additive to the drying chamber; and a controller in operable communication with the additive dispensing assembly, the controller being configured to initiate a drying operation comprising:

obtaining washer operating parameters from a washing machine appliance, determining a dryer operating schedule based on obtaining the washer operating parameters, initiating a dry cycle for a laundry load, and directing a dispensing action of the dryer additive at the additive dispensing assembly based on the dryer operating schedule.

2. The dryer appliance of claim 1, wherein the washing machine appliance is linked to the dryer appliance.

3. The dryer appliance of claim 2, wherein at least one of the washing machine appliance and the dryer appliance is linked to a consumer device.

4. The dryer appliance of claim 1, wherein determining the dryer operating schedule comprises determining an amount of water to be removed from the laundry load in response to obtaining washer operating parameters.

5. The dryer appliance of claim 1, wherein directing the dispensing action comprises:

retrieving a dry weight of the laundry load in response to washer operating parameters;

determining an additive volume of the dryer additive based on the dry weight of the laundry load; and dispensing the additive volume from the additive dispensing assembly to the drying chamber.

6. The dryer appliance of claim 5, wherein determining the additive volume comprises selecting the additive volume from a plurality of predetermined volumes.

7. The dryer appliance of claim 6, wherein each of the plurality of predetermined volumes correlates to a specific dry laundry weight.

8. The dryer appliance of claim 1, wherein the drying operation further comprises:

determining a frequency of additive additions; and determining a dispense time within the dry cycle for adding the additive following the determination of the dryer operating schedule.

9. The dryer appliance of claim 1, wherein the dryer additive comprises a perfume or odor neutralizer.

10. A method of operating a dryer appliance comprising a cabinet, a drum defining a drying chamber, and an additive dispensing assembly, the method comprising:

obtaining washer operating parameters from a washing machine appliance;

determining a dryer operating schedule based on obtaining washer operating parameter;

initiating a dry cycle for a laundry load following obtaining the washer operating parameters; and directing a dispensing action of a dryer additive at the additive dispensing assembly based on the dryer operating schedule.

11. The method of claim 10, wherein the washing machine appliance is linked to the dryer appliance.

12. The method of claim 11, wherein at least one of the washing machine appliance and the dryer appliance is linked to a consumer device.

13. The method of claim 10, wherein determining the dryer operating schedule comprises determining an amount of water to be removed from the laundry load in response to obtaining washer operating parameters.

14. The method of claim 10, wherein directing the dispensing action comprises:

determining a dry weight of the laundry load in response to washer operating parameters;

determining an additive volume of the dryer additive based on the dry weight of the laundry load; and dispensing the additive volume from the additive dispensing assembly to the drying chamber.

15. The method of claim 14, wherein determining the additive volume comprises selecting the additive volume from a plurality of predetermined volumes.

16. The method of claim 15, wherein each predetermined volume of the plurality of predetermined volumes correlates to a specific dry laundry weight.

17. The method of claim 10, further comprising:

determining a volume of additive to be added;

determining a frequency of additive additions; and determining a dispense time within the dry cycle for adding the additive following the determination of the dryer operating schedule.

18. The method of claim 10, wherein the dryer additive comprises a perfume or odor neutralizer.

* * * * *